US011103034B2

(12) United States Patent
Surana

(10) Patent No.: US 11,103,034 B2
(45) Date of Patent: Aug. 31, 2021

(54) ADJUSTABLE FINGER RING

(71) Applicant: Girishkumar Hirachand Surana, Hunghom (HK)

(72) Inventor: Girishkumar Hirachand Surana, Hunghom (HK)

(73) Assignee: Surana Brothers IP Holdings Limited, Hunghom (HK)

( * ) Notice: Subject to any disclaimer, the term of this patent is extended or adjusted under 35 U.S.C. 154(b) by 0 days.

(21) Appl. No.: 16/389,965

(22) Filed: Apr. 21, 2019

(65) Prior Publication Data

US 2020/0237060 A1 Jul. 30, 2020

(30) Foreign Application Priority Data

Jan. 31, 2019 (HK) ..... 19101827.6

(51) Int. Cl.
*A44C 9/02* (2006.01)

(52) U.S. Cl.
CPC ..... *A44C 9/02* (2013.01)

(58) Field of Classification Search
CPC ..... A44C 9/02; A44C 9/00; A44C 17/0233; A44C 17/0208; A44C 9/0061; A44C 5/0007; A44C 5/12; A44C 5/0084; A44C 5/0092; Y10T 24/1441; Y10T 24/1443; Y10T 24/1445
USPC ..... 63/15.45, 15.5, 15.65, 15.6, 15, 40; 24/279, 180, 281, 282
See application file for complete search history.

(56) References Cited

U.S. PATENT DOCUMENTS

| | | | | | |
|---|---|---|---|---|---|
| 859,162 | A * | 7/1907 | Worth | A44C 17/0208 | 63/30 |
| 1,920,875 | A * | 8/1933 | Miskend | A44C 17/0258 | 63/15 |
| 3,959,989 | A * | 6/1976 | Bhandia | A44C 9/02 | 63/15.65 |
| 4,059,872 | A * | 11/1977 | Delesandri | F16L 3/1008 | 24/284 |
| 4,158,951 | A * | 6/1979 | Cedar | A44C 5/2042 | 24/265 BC |
| 4,977,757 | A * | 12/1990 | Mesica | A44C 9/00 | 63/15 |
| 5,720,086 | A * | 2/1998 | Eliasson | F16L 33/04 | 24/279 |
| 6,612,132 | B2 * | 9/2003 | Kimura | A44C 17/0275 | 63/15 |
| 7,178,365 | B2 * | 2/2007 | Pitaniello | A44C 5/00 | 63/15 |
| 2011/0179825 | A1 * | 7/2011 | Katzir | A44C 13/00 | 63/15.1 |
| 2020/0163423 | A1 * | 5/2020 | Nelson | A44C 5/0084 | |

* cited by examiner

*Primary Examiner* — Jack W Lavinder

(57) ABSTRACT

An adjustable finger ring consisting of a ring with an opening including connection holes with a connection piece. The connection piece includes fasteners on the outer side of the ring to regulate the size of the ring. The finger ring can adjust the size of its opening depending on the diameter of the finger to provide the finger with a proper ring size. After adjusting the ring, the fasteners are used to fix the size of the ring. The design is easy to operate and practical to use.

11 Claims, 3 Drawing Sheets

ADJUSTABLE FINGER RING

CROSS-REFERENCE TO RELATED APPLICATION

This patent application claims priority to Chinese Patent Application 201930051335.X filed on Jan. 29, 2019, now pending, and Hong Kong Patent Application No. 19101827.6 filed on Jan. 31, 2019, now pending.

BACKGROUND OF THE INVENTION

1. Field of the Invention

The present invention relates to the field of finger rings and more particularly, to finger rings with an adjustable size.

2. Background

Finger rings are a type of jewelry that is worn on fingers. They consist of a ring fitting onto fingers. The rings are decorated around the ring with materials such as rare stones. At present, the traditional rings on the market are those with fixed inner diameters. When the finger diameter of a ring wearer fluctuates, the ring will not fit comfortably. This entails frequent modifications of ring size and the modifications are inconvenient to perform. Therefore, there is a need for an improved finger ring with an adjustable ring that is easy to operate.

SUMMARY OF THE INVENTION

The present invention is an adjustable finger ring. The adjustable ring consists of a ring with an opening including connection holes with a connection piece. The connection holes are set in proportion and the connection pieces are detachable after putting the connection piece into the connection holes. The connection piece includes fasteners on the outer side of the ring to regulate the size of the ring. The finger ring can adjust the size of its opening depending on the diameter of the finger to provide the finger with a proper ring size. After adjusting the ring, the fasteners are used to fix the size of the ring. The design is easy to operate and practical to use.

In addition, by the side of the opening there is only one connection hole. One side of the connection piece is fixed as a part of the finger ring, while its other side goes through the connection hole.

In addition, the connection is a screw shaft. The connection hole matches in size with the screw shaft. The fastener is a screw cap or a nut.

In addition, the connection piece has a center piece fixed on it, and the center piece is placed into the opening.

In addition, the center piece includes a support piece and a decorative piece mounted on the support piece. The support piece has a mounting hole that is a match with the connection piece. With the mounting hole, the support piece can be fixed on and detached from the connection piece.

In addition, the decorative piece is selected from the group consisting of diamond, jade, pearl, amethyst or crystal.

In addition, the outer surface of the ring is mounted with decorations.

In addition, the opening ends of the finger ring are shaped in an outward curve.

In addition, the finger ring is made of gold, platinum or pure silver.

In comparison with prevailing technologies, the present invention brings the following benefits:

The finger ring in the present invention has an adjustable opening size subject to the diameter of fingers, accommodating the finger with a proper ring size. After adjusting the ring, the fasteners are used to fix the size of the ring. The design is easy to operate and practical in use.

Further novel features and other objects of the present invention will become apparent from the following detailed description, discussion and the appended claims, taken in conjunction with the drawings.

BRIEF' DESCRIPTION OF THE DRAWINGS

Referring particularly to the drawings for the purpose of illustration only and not limitation, there is illustrated:

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The following is a detailed description of the present invention based on the drawings in FIGS. 1-7 and the detailed description.

Figure 1:
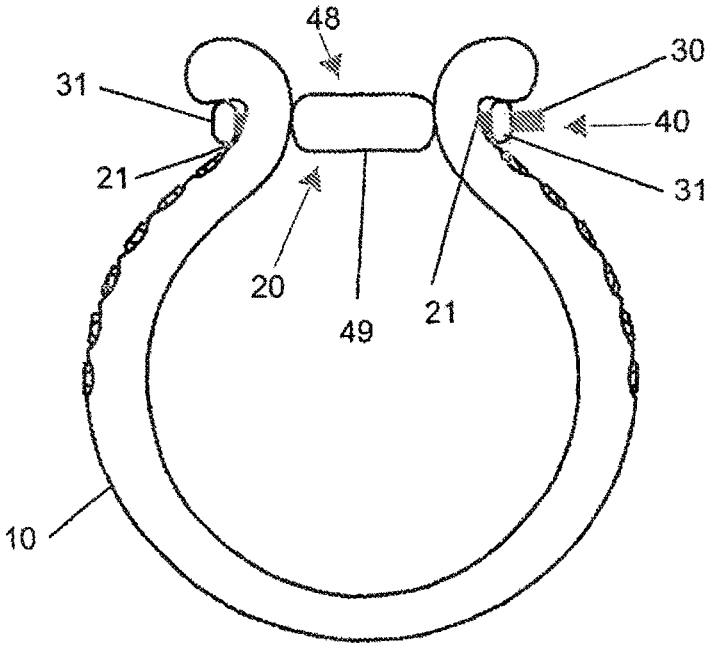
FIG. 1 is a side perspective view of the adjustable finger ring of the present invention.

FIG. 1 is a side perspective view of the adjustable finger ring of the present invention. It consists of a finger ring 10 which has an adjustable opening 20. By the side of the adjustable opening 20 there are connection holes 21 with a connection piece 40. The connection piece 40 includes fasteners 31 on the outer side of the finger ring 10 to regulate the size of the ring. The finger ring 10 has adjustable opening 20 sized subject to the diameter of the finger, to accommodate the finger with a proper finger ring 10 size. After adjusting the size of the finger ring 10, the fasteners 31 are used to fix the size of the finger ring 10.

One technical model of the present invention is performed by having connection holes 21 by the side of the opening 20. The connection holes 21 are set in proportion and the connection pieces 40 are detachable after being placed into the connection holes 21. The connection piece 21 includes fasteners 31 on the outer side of the ring 10 to regulate the size of the ring 10. Because the connection piece 40 goes into the connection hole 21, frequent adjustments of the ring 10 size will cause damage such as aging and bending of the connection piece 40. Therefore, the connection piece 40 is detachable from the connection hole 21 to enable changes of connection pieces 40 from time to time. This is convenient and practical in use.

Another technical mode of the present invention is that by the side of the opening 20 there is only one connection hole 21. One end of the connection piece 40 is fixed as a whole with the finger ring 10, while its other end goes through the connection hole 21. The connection piece 40 has a fastener 31 against the connection hole 21. The fastener 31 is used to regulate the size of finger ring 10. In the present invention, the connection piece 40 is fixed into one piece (with the ring) by soldering.

More specifically, the connection piece 40 is a screw shaft 30. The connection hole 21 is a screw hole or a round hole that fits the screw shaft 30. The fastener 31 is a screw cap or a nut. Ideally, the screw shaft 30 will be T-shaped.

In addition, there is a center piece 49 mounted on the connection piece 40. The center piece 49 is placed into the opening 20. By adding a center piece 49 onto the connection piece 40, the ring is more appealing to satisfy consumer requirements.

Figure 2:
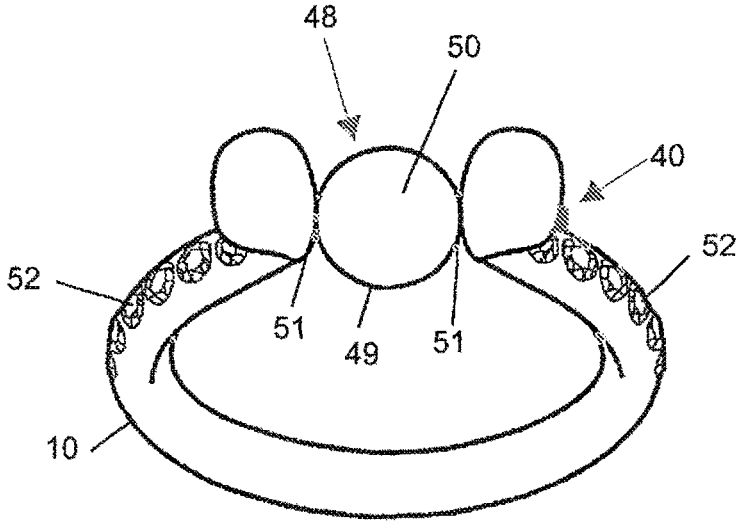
FIG. 2 is a top/side perspective view of the adjustable finger ring.
Figure 3:
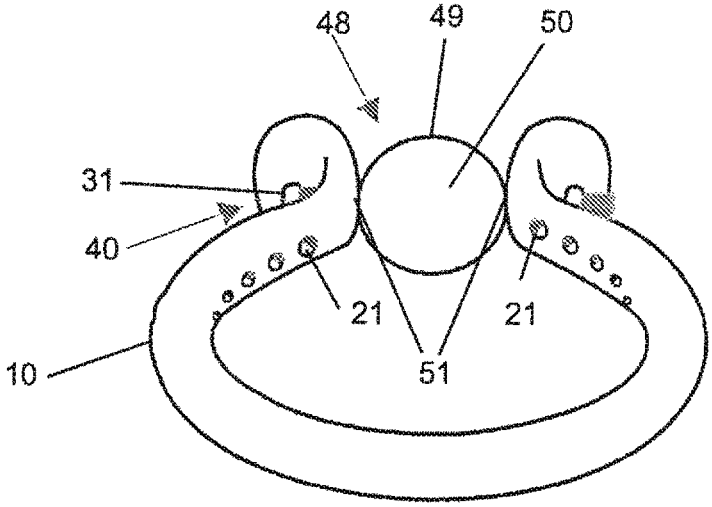
FIG. 3 is another top/side perspective view taken from an opposite side from the view taken in FIG. 2, of the adjustable finger ring of the present invention.
Figure 4:
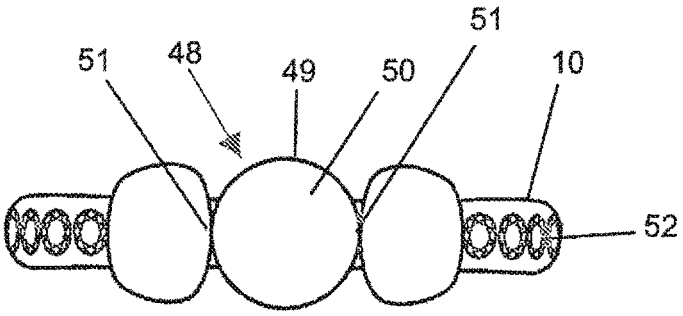
FIG. 4 is a top view of the adjustable finger ring of the present invention.
Figure 5:
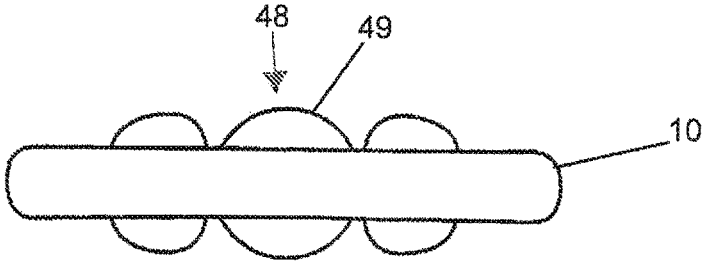
FIG. 5 is a bottom view of the adjustable finger ring of the present invention.
Figure 6:
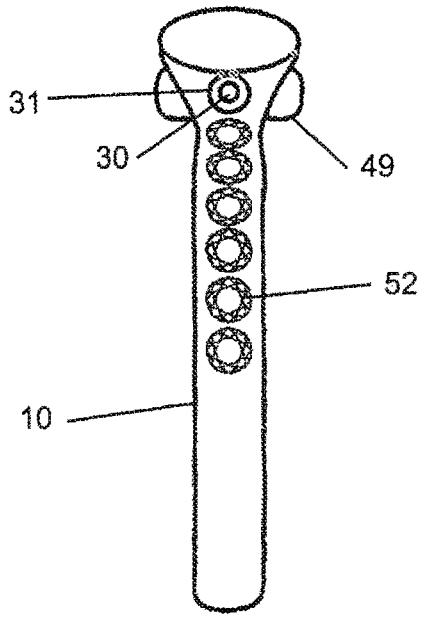
FIG. 6 is a left side view of the adjustable finger ring of the present invention.
Figure 7:
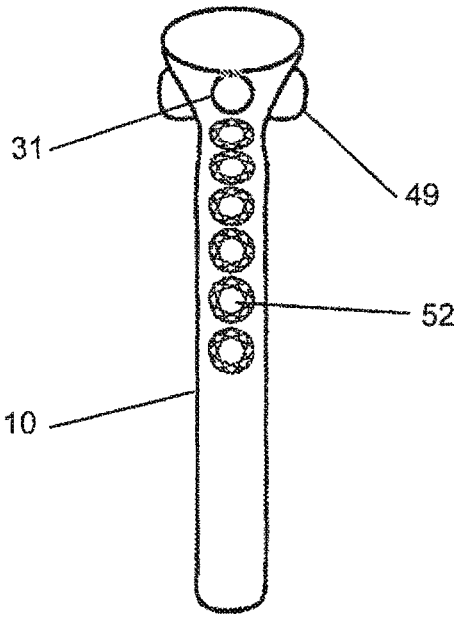
FIG. 7 is a right side view of the adjustable finger ring of the present invention.

FIG. 2 is a top/side perspective view of the adjustable finger ring. As shown in FIG. 2, the center piece includes a support piece 48 and a decorative piece 50. The decorative piece 50 is fixed onto the support piece 48, while the support piece 48 has a mounting hole that is a match with the connection piece. With the mounting hole, the support piece 48 can be fixed on and detached from the connection piece. This mounting procedure can, on the one hand, fix the center piece on the connection piece and prevent its falling off. On the other hand, users will be able to conveniently change the center pieces as necessary on different occasions. In this technical mode, the decorative piece 50 is selected from the group consisting of diamond, jade, pearl, amethyst or crystal.

To enhance the ring's attractiveness, the outer surface of the ring 10 is mounted with a decorative piece 52. The decorative piece 52 is one or more of the following: diamond, jade, pearl, amethyst or crystal.

In addition, the opening 20 ends of the finger ring 10 are shaped in an outward curve. The curve serves as a diversion for the ends of the opening and therefore enhancing the attractiveness of the ring.

In the present invention, the finger ring 10 is made of gold, platinum or pure silver.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A finger ring comprising:

(a) a band including a finger opening surrounded by a sidewall including an opening separating a first connection hole and a second connection hole; and (b) a connecting screw extending through the first connection hole with a proximal end exterior to the first connection hole, the connection screw including a threaded shaft extending through the second connection hole;

(c) a removable center piece inserted between said first connection hole and said second connection hole;

(d) an opening in said center piece through which said threaded shaft passes;

(e) a threaded fastener positioned exterior to the second connection hole, wherein tightening the threaded fastener on the threaded shaft secures the removable centerpiece between the first connection hole and the second connection hole and loosening and removing the threaded fastener allowing changing the removable center piece inserted between said first connection hole and said second connection hole.

2. The finger ring in accordance with claim 1, wherein the removable center piece comprises:

(a) a support piece, the opening form therethrough; and (b) a decorative piece attached to the support piece.

3. The finger ring in accordance with claim 2, comprising: said decorative piece is selected from the group consisting of diamonds, jade, pearls, amethyst and crystal.

4. The finger ring in accordance with claim 1, comprising: a portion of said finger ring including said first hole and said second hole are each shaped in an outward direction relative to said band.

5. The finger ring in accordance with claim 1, comprising: said finger ring is made out of material selected from the group consist in of gold, platinum and silver.

6. A finger ring comprising:

(a) a band including a finger opening surrounded by a sidewall including an opening separating a first connection hole and a second connection hole;

(b) a connecting member extending through the first connection hole with a proximal end positioned outside the ring and proximate the first connection hole, the connection member including a shaft extending through the second connection hole and a fastener removably attached to a distal end of the shaft;

(c) a removable center piece inserted between said first connection hole and said second connection hole; and (d) an opening in said center piece through which said shaft passes.

7. The finger ring in accordance with claim 6, comprising:

(a) said removable center piece includes a support piece and a decorative piece thereon;

(b) said support piece includes said opening that is sized to allow said shaft to pass through; and (c) said support piece is selected from the group consisting of fixed on said connecting member and detachable from said connection member.

8. The finger ring in accordance with claim 7, comprising: said decorative piece is selected from the group consisting of diamonds, jade, pearls, amethyst and crystal.

9. The finger ring in accordance with claim 6, comprising: a portion of said finger ring including said first connection hole and said second connection hole are each shaped in an outward direction relative to said band.

10. The finger ring in accordance with claim 6, comprising: said finger ring is made out of material selected from the group consisting of gold, platinum and silver.

11. The finger ring in accordance with claim 6, comprising: said connecting member is a screw extending through the first connection hole with a proximal end positioned outside of the ring and adjacent to the first connection hole, the screw including a threaded shaft extending through the second connection hole and a threaded fastener at a distal end of the threaded shaft.

* * * * *